US007490859B2

(12) United States Patent
Coing

(10) Patent No.: US 7,490,859 B2
(45) Date of Patent: Feb. 17, 2009

(54) DEVICE FOR RETAINING A BOOT ON A SNOWBOARD

(75) Inventor: Patrice Coing, Meylan (FR)

(73) Assignee: Skis Rossignol SA, Voiron Cedex (FR)

( * ) Notice: Subject to any disclaimer, the term of this patent is extended or adjusted under 35 U.S.C. 154(b) by 563 days.

(21) Appl. No.: 11/166,505

(22) Filed: Jun. 24, 2005

(65) Prior Publication Data

US 2006/0290105 A1 Dec. 28, 2006

(51) Int. Cl.
*A63C 9/00* (2006.01)

(52) U.S. Cl. ..... 280/817; 280/607; 280/618; 280/14.21

(58) Field of Classification Search ..... 280/613, 280/616, 617, 618, 623, 626, 627, 629, 632, 280/634, 817
See application file for complete search history.

(56) References Cited

U.S. PATENT DOCUMENTS

| | | | | |
|---|---|---|---|---|
| 6,015,161 | A | 1/2000 | Carlson | 260/633 |
| 6,062,584 | A * | 5/2000 | Sabol | 280/607 |
| 6,065,768 | A * | 5/2000 | Lee | 280/613 |
| 6,102,430 | A * | 8/2000 | Reynolds | 280/618 |
| 6,196,569 | B1 * | 3/2001 | Berger et al. | 280/607 |
| 6,203,051 | B1 * | 3/2001 | Sabol | 280/607 |
| 6,523,851 | B1 * | 2/2003 | Maravetz | 280/603 |
| 6,994,370 | B2 * | 2/2006 | Sabol | 280/618 |
| 7,281,717 | B2 * | 10/2007 | Sacco et al. | 280/14.22 |
| 2001/0038183 | A1 | 11/2001 | Gorza et al. | 280/14.24 |
| 2003/0184031 | A1 | 10/2003 | Feurer et al. | 280/14.24 |

FOREIGN PATENT DOCUMENTS

| | | |
|---|---|---|
| EP | 1106215 | 6/2001 |
| FR | 2742997 | 7/1997 |
| FR | 2834909 | 7/2003 |
| WO | WO 97 22390 | 6/1997 |

* cited by examiner

*Primary Examiner*—Christopher P Ellis
*Assistant Examiner*—Bridget Avery
(74) *Attorney, Agent, or Firm*—Fay Sharpe LLP

(57) ABSTRACT

A binding for a boot includes a platen (4) which is manually mountable to a snowboard in a selected angular position. The platen includes a central hole (4*a*) and a circular array of upwardly facing teeth (4*c*). A base (9), mounted to the snowboard, has a spindle (16) and locking arms (16*a*, 16'*a*) which extend through the platen central hole. A central pivot body (5) includes a circular peripheral surface (5*a*) and downwardly projecting teeth (5*b*) which interact with the central hole and teeth of the platen. Ramping cam elements (8*d*, 8'*d*) on a locking disk engage the locking arms and progressively clamp the pivot body to progressively press the teeth of the pivot body against the teeth of the platen to prevent rotation. A clamp (22) having cam ends (22*a*, 22'*a*) is pivotal between a vertical release position which permits the central locking disk to rotate and a flat position which locks the central locking disk against rotation.

16 Claims, 10 Drawing Sheets

DEVICE FOR RETAINING A BOOT ON A SNOWBOARD

BACKGROUND

The present invention concerns a binding for a boot on a sliding board, particularly a snowboard. It concerns, more particularly, the binding of the snowboard and its means of angular position adjustment.

Skis are of different types, such as, alpine skis, hiking skis, cross-country skis, jumping skis, and skis for the acrobatic skiing.

But a snow ski board called a snow board also exists, of which the width is sufficiently wide to be able to keep the two boots of the skier, in an angled position, so as to say at an angle with the general plane of symmetry of the board, the front boot facing towards the right for a right-handed skier, or towards the left for a lefty. Thus, one of the feet is placed in front of the other foot, each of the boots being in a different angular position to the other boot. One will also note every user wishes to be able to regulate the angular position of their boots, in a particular manner such that this adjustment can be modified.

Thus, the boots of the user are mounted on the snowboard, for example, on a plate that is mounted in a non-adjustable manner to the snowboard in the chosen angular position, mounted on a pivot including means of attachment that allow adjustment of the angular position, by rotation around a vertical axis, and immobilized by locking in the aforementioned plate.

All the traditional devices are not very practical, and often not very reliable, and all have as an inconvenience the play that inevitably exists between the plate and the board, this play being simply to tolerate the fabrication, and the result in wear of the product. The movement of the plate due to the play is particularly unpleasant for a user that looks to have a perfect path of its trajectory.

One knows also the device shown in US 2003/0184031 made by the petitioner, according to which it is foreseen a base affixed to the board, to which a plate is retained in a removable manner, the plate can be oriented according to a chosen orientation, the taking up of the possible play is realized by a central screw. Nevertheless, this device necessitates a tool to maneuver to central screw.

One knows also the device described in US 2001/0038183 according to which the base is removable and can be positioned on a base fixed to the snowboard according to a determined orientation. But this device that does not necessitate special tools and does not allow taking up of the inevitable play.

SUMMARY

The presents invention, proposes a new, particularly simple device, easy to put in operation, and reliable, according to which the angular adjustment of the plate itself is done manually, without special tools, and which plate can be disconnected from base in the same way, that is to say manually, without a tool. The device of the invention allows besides the taking up of the inevitable play, between the plate and the board.

Thus, according to the invention, the retaining device for a boot on a snowboard includes a platen, provided with binding means for the boot, a central retaining body or vertical axis pivot including a pivot body situated in the central zone of the platen, and destined to mount the platen on the snowboard, due to a manual locking system that assures the retention of the pivot on the base affixed to the snowboard, and is characterized in that the retention of the pivot on the base is realized thanks to the cooperation of a system of ramps of a central disk of a locking pivot, with at least one interacting projection joined to the base.

According to a supplementary characteristic, the pivot body includes on its lower face a lower recess in which the base is received, the aforementioned recess having a complimentary form to the base to prevent the pivot body to move in translation or in rotation relative to the base.

According to another supplementary characteristic, the platen includes a central hole destined to receive and cooperate with the pivot body, the aforementioned central hole central including, besides a peripheral edge of which the upper, transverse face, includes a circular array of teeth including a succession of ridges and radial grooves, destined to cooperate with a circular array of teeth including a succession of ridges and radial grooves defined on a lower transverse face of a peripheral edge defined on the aforementioned pivot body.

Besides, the base includes two locking arms spreading horizontally towards the exterior from a vertical axis and destined to cooperate with the system of ramps, while the central locking disk includes a central hole destined to receive and cooperate with the base that includes a peripheral edge including on its upward facing horizontal face (8*d*), a ramp system having two diametrically opposite symmetric ramps. Note also that the two ramps carry a circular array of teeth constituted of a succession of ridges and hollow grooves.

The two support ramps form camming ramps by their cooperation with the locking arms of the base, the peripheral edge including two peripheral edge portions, including a first portion and a second one diametrically symmetrical to the first portion, that are such that the height of each of these portions varies.

Add that the pivot includes a maintenance cover that keeps the elements of the aforementioned pivot together, including the pivot body, the maintenance disk, and the central locking and unlocking disk.

One will understand that thanks to the means of the invention, the professional for mounting bindings, will be able to prepare snowboards with the base of the invention and will be able there to affix different types of plates, and this while choosing the desired plate.

The invention concerns also snowboard equips these bases.

Still further advantages of the present invention will be appreciated to those of ordinary skill in the art upon reading and understanding the following detailed description.

BRIEF DESCRIPTION OF THE DRAWINGS

The invention may take form in various components and arrangements of components, and in various steps and arrangements of steps. The drawings are only for purposes of illustrating the preferred embodiments and are not to be construed as limiting the invention.

FIG. 5 is a cross-sectional view along C-C of FIG. 5*a* which is a top view.

DETAILED DESCRIPTION

Figure 2:
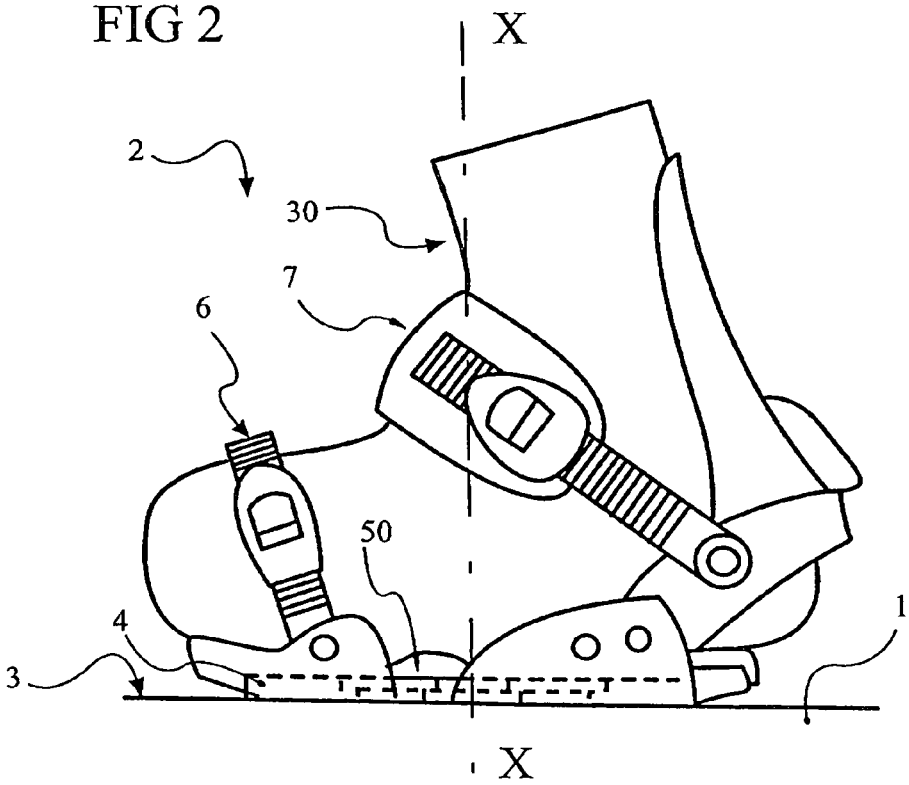
FIG. 2 is a side view of the binding for the boot.
Figure 3:
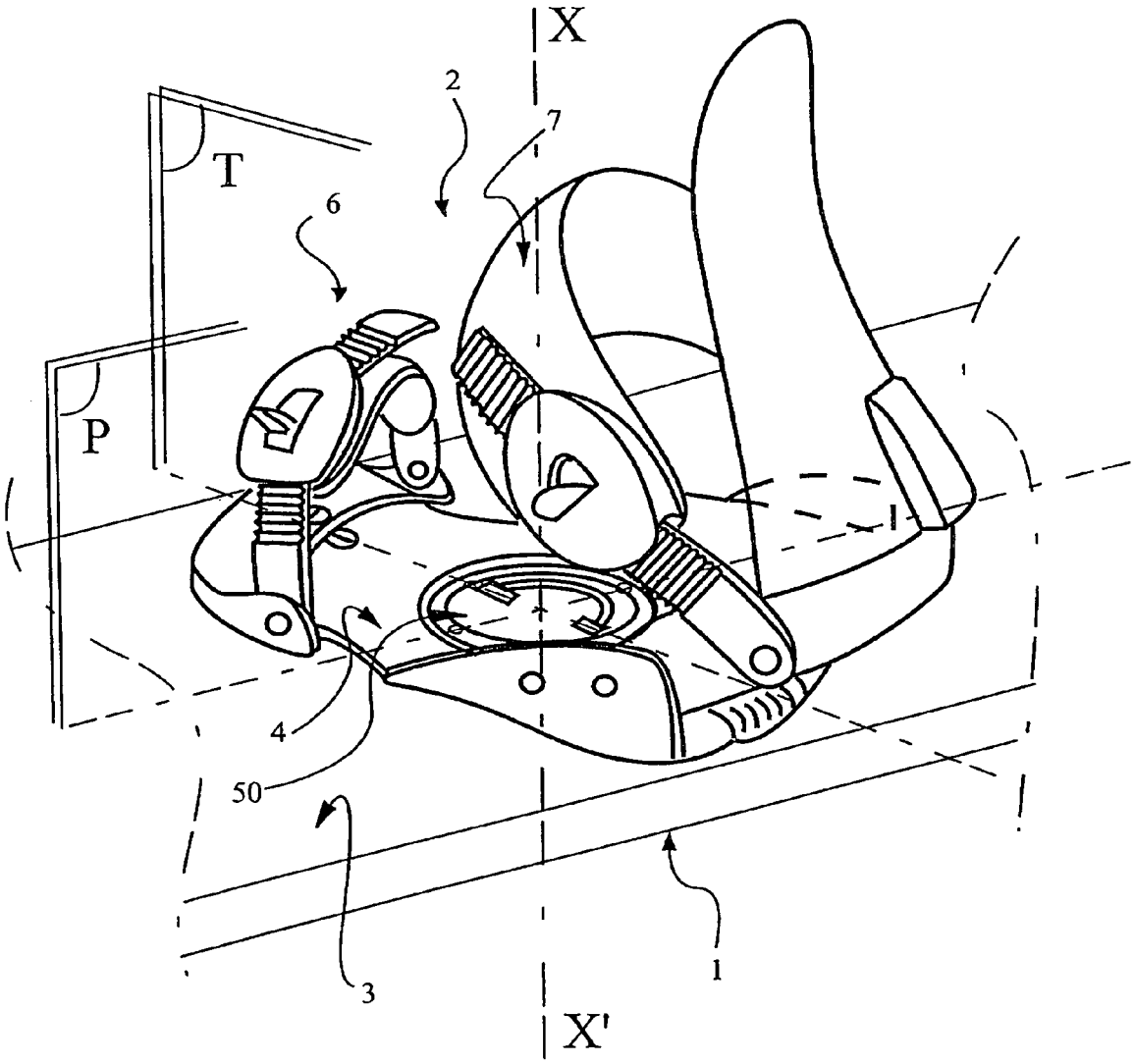
FIG. 3 is a perspective view of one of the bindings, but without the back.
Figure 4:
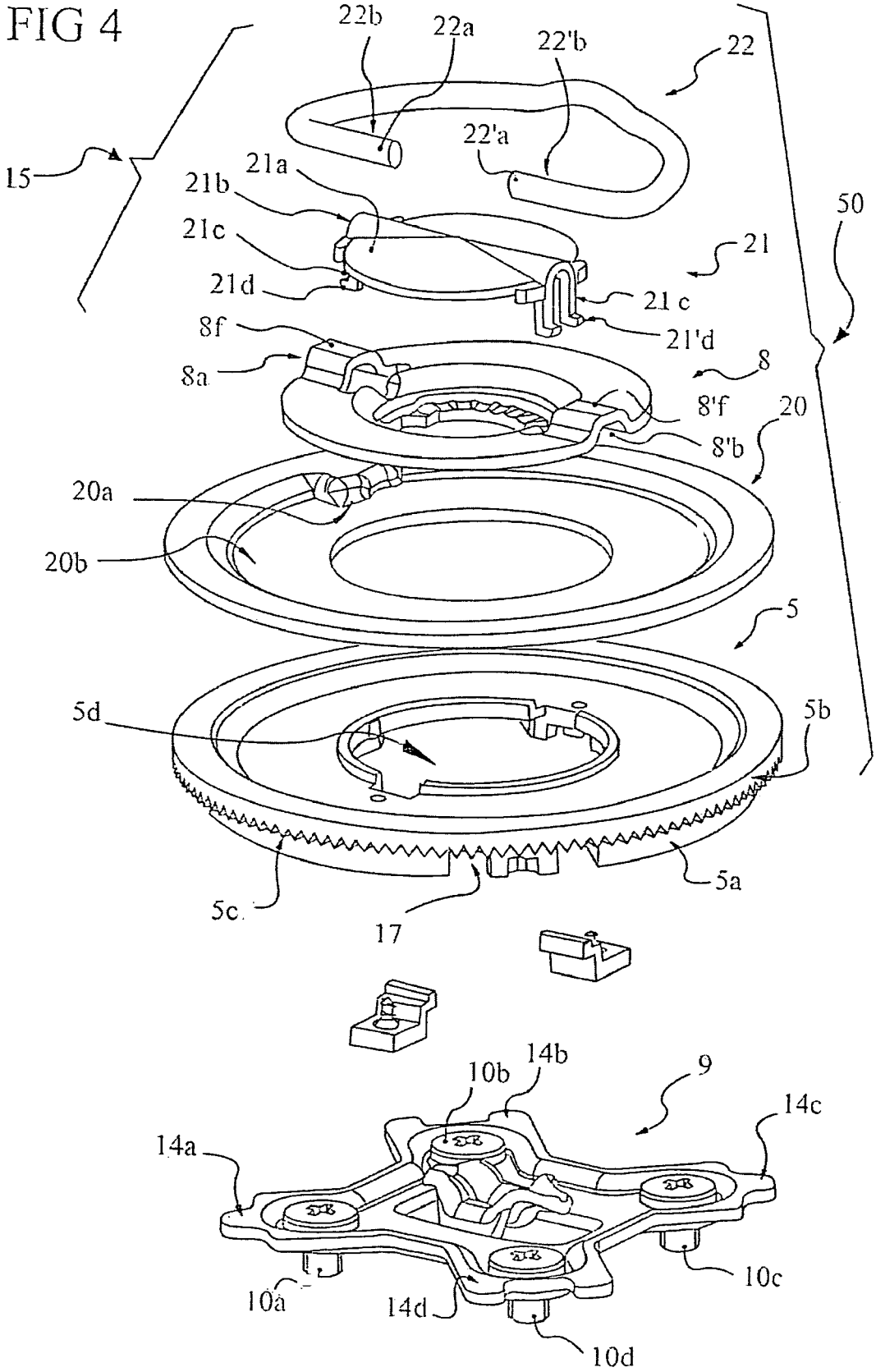
FIG. 4 is an expanded, perspective view of the means of affixing the plate to the base, showing all the constituent elements.
Figure 5:
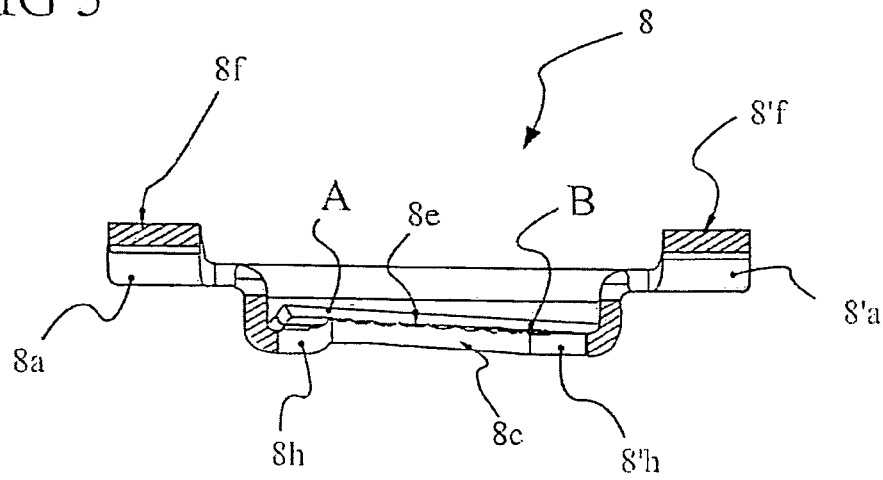
FIGS. 5 and 5*a* represent the central locking disk.
Figure 5A:
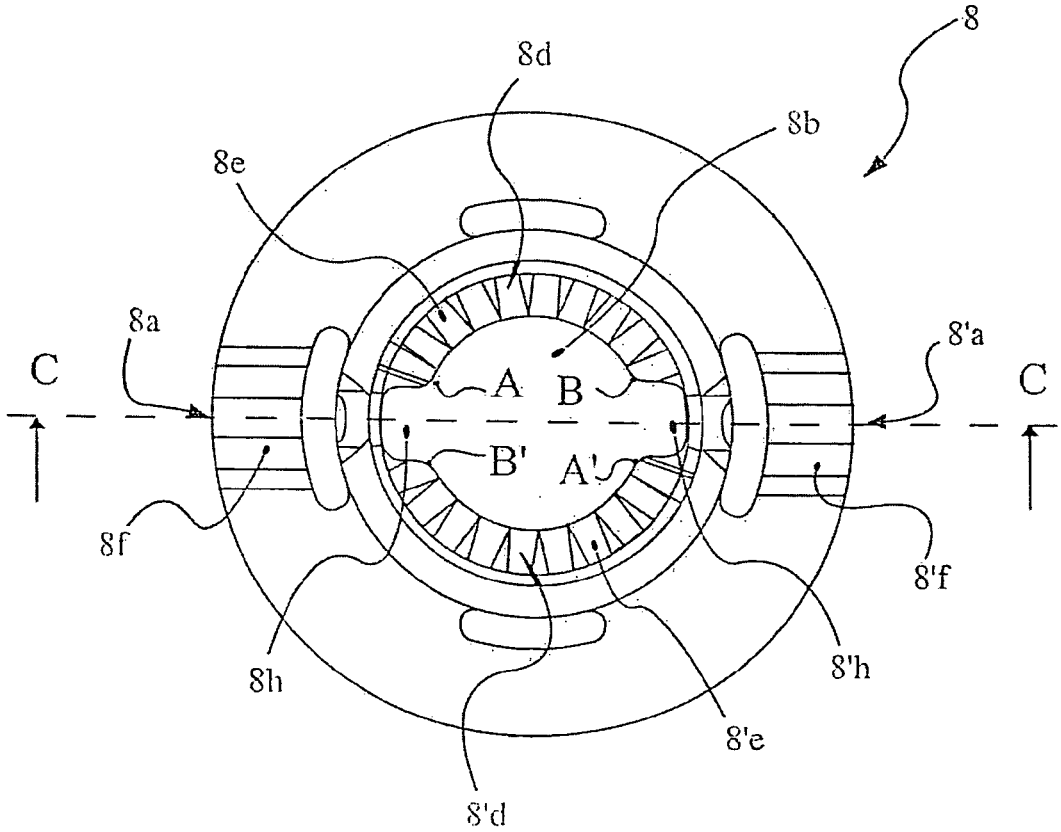

A snowboard 1 designed for snowboarding with a vertical plane of general symmetry (P), includes two mounting devices 2*a*, 2*b* also called bindings to hold the two boots 30 of the user onto the snowboard. The two bindings are mounted on the upper surface 3 of the snowboard 1 in such a manner that their respective plane of general symmetry (T) is on a bias in comparison to the vertical plane of general symmetry (P) of the snowboard 1, such as illustrated in FIGS. 1, 2, and 3, but as appears more particularly in FIG. 1.

Thus, the general plane of symmetry (T) of the front binding 2*a* forms, with the vertical plane of general symmetry (P) of the snowboard, an acute angle (A) opening towards the front (AV), while the general plane of symmetry (T) of the rear binding 2*b* forms, also, with the plane (P) an acute angle (B) opening towards the front (AV).

Figure 1:
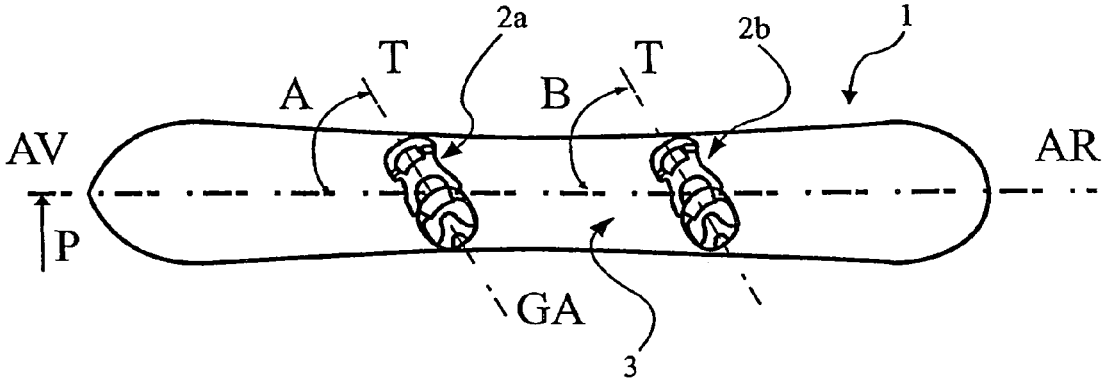
FIG. 1 is a top view of a snowboard, equipped with two bindings for the boots of the user.

The snowboard illustrated in FIG. 1 represents a binding for a right handed skier, that is to say, that the angles (A) and (B) are opened towards the front (AV) and towards the right (DR). For a lefty, the angles (A) and (B) would be opened towards the front (AV) and towards the left (GA). One will also note as the angle (A) of the front binding 2*a*, is different from the angle (B) of the rear binding 2*b*.

One will describe hereafter, one of the bindings will be designated with the general reference number 2) which includes the means allowing it to be retained and fixed on the snowboard in the chosen angular position.

To this effect, the binding 2 is constituted by a platen 4, or support plate on which is affixed the boot 30 of the user by any appropriate means, the aforementioned platen being kept on the snowboard by its central part thanks to a central holding piece or circular pivot 5 and that presents itself in the form of a disk with a vertical axis (X', X"), allowing the user to adjust the angular position of the platen, by rotation around the vertical axis (X', X"), thus to assure locking in the chosen position.

According to the described embodiment, the platen 4 is present in the form of an elongated plate spreading horizontally, on which, the boot is affixed, for example, by a front retaining device 6 retaining the front of the boot, and a rear retaining device 7 retaining the aforementioned boot.

The front retaining device 6 and the rear retaining device 7 are, according to the illustrated embodiment in the present example, constituted by a semi-rigid strap, for example, in plastic, including advantageously an adjustment means to adapt to the voluminal dimensions of the aforementioned boot. All other binding means for the boot can be foreseen, other than of the semi-rigid strap, as for example, according to the means described in the French patent application No. 2,742,997, or in the International published patent application No. WO 97/22390.

According to a characteristic of the invention, the pivot 50 is fixed in a removable manner on the base 9, affixed to the snowboard 1, for example, by four binding screws 10*a*, 10*b*, 10*c*, 10*d*.

Additionally, the platen 4 includes a central hole 4*a* destined to receive and cooperate with the pivot 50. This central hole includes, besides, a peripheral edge 4*b* including on its transverse turned up face, circular teeth 4*c* constituted of a succession of ridges and radial troughs of which the function will be explained.

The base 9 realized, for example, in plastic or in any other material, such as, for example, in aluminum or others, has the general form of a cross, of which each of the angles constitutes an angular arm 14*a*, 14*b*, 14*c*, 14*d* spreading in a diagonal manner, while each of the diagonal arms includes a through hole destined to receive the screws 10*a*, 10*b*, 10*c*, 10*d*, affixing them to the snowboard. One will note that, according to the described embodiment, the diametrically opposite angular arms of one of the diagonals have a different form than the other diagonal, this allows the operator to put the orientation of the corresponding pivot in a defined place.

The base 9 includes a horizontal anchoring or locking spindle 16 constituted by two anchoring or locking projections 16*a*, 16'*a* spreading horizontally towards the exterior from the vertical axis (X', X").

Figure 10:
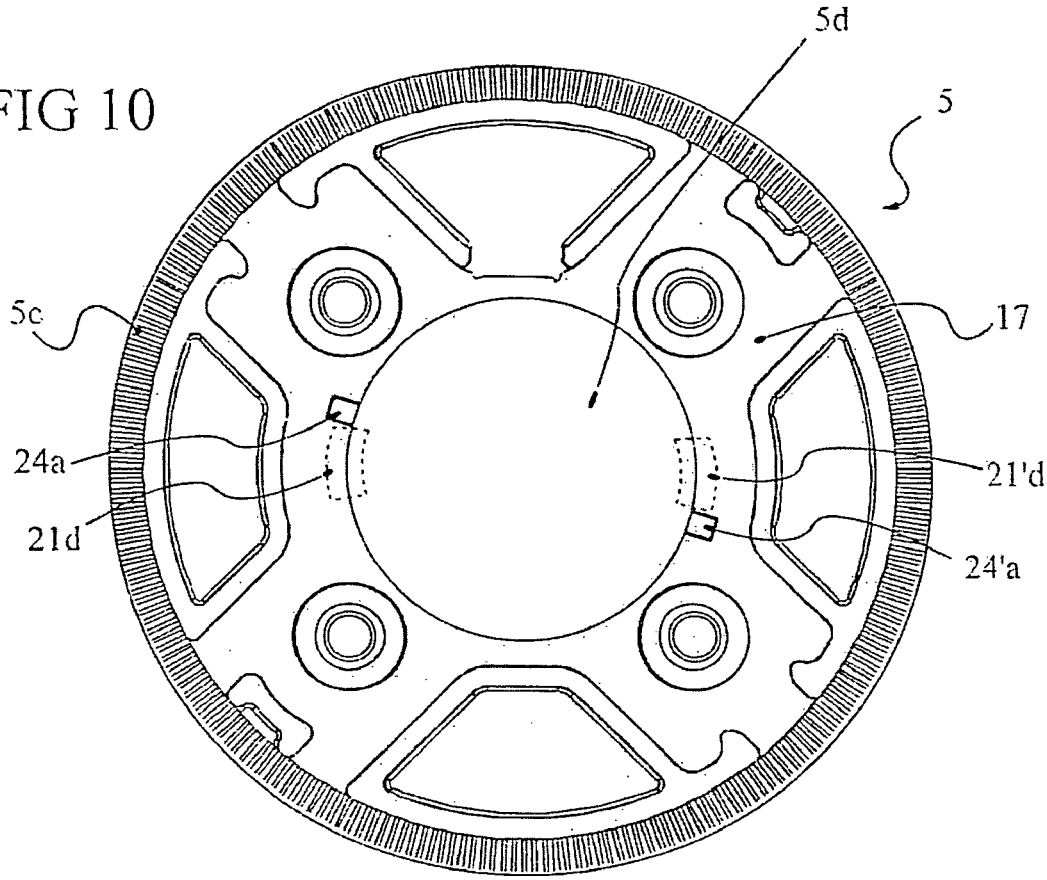
FIG. 10 is a bottom view of the pivot body.
Figure 11:
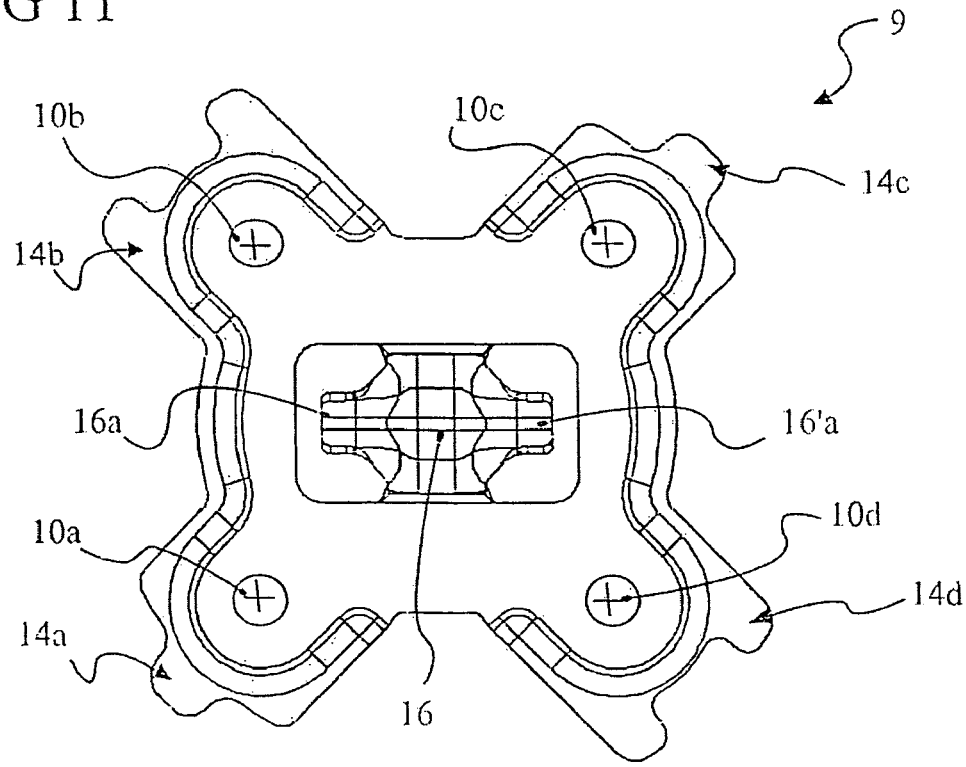
FIG. 11 is a top view of the base affixed to the snowboard.

The pivot 50 is principally constituted by a pivot body 5, of a general circular form and includes on its lower face, a lower recess 17 in which the base 9 is engaged. Also, this recess is formed of corresponding dimensions to the base 9, in regards to its periphery, such as shown in FIGS. 10 and 11. Thus, the body of the pivot 5 in the mounting position cooperates with the base 9 thanks to its lower recess 17 which fits together with the aforementioned base 9, the pivot body 5 thus being blocked against rotation by receipt to the base 9.

One will note that the pivot body 5 includes a peripheral circular rotation wall 5*a* which cooperates with the corresponding circular wall 4*d* of the central hole 4*a* of the platen 4, functioning as a pivot for the latter. The aforementioned pivot body 5 includes besides, a central hole 5*d* destined to assure the passage and the relative movement of the locking spindle with its locking projections 16*a*, 16'*a* and attaching legs 21*c*, 21'*c*.

The vertical retention of the platen 4 is assured by the pivot due to a peripheral edge 5*b* which projects towards the exterior, destined to cooperate with the peripheral edge 4*b*, central 4 of the aforementioned platen.

The locking of the pivot body 5 on the base 9 allows therefore the retention toward the top of the platen 4 by cooperation of the peripheral edge 5*b* with the peripheral edge 4*b* of the central hole 4, but also the locking in the angular position chosen at the time of the mounting. To this effect, the transverse lower face of the peripheral edge 5*b* pivot includes a circular array of teeth 5*c* constituted of a succession of projections and of radial troughs provided to cooperate with the circular array of teeth 4*c* corresponding realized on the upper face of the peripheral edge 4*b* of the central hole 4*a* of the platen.

The cooperation of the teeth 5*c* of the pivot 5 with the teeth 4*c* of the platen allows blocking the rotation of the base 9 when the pivot is affixed on the base 9.

The pivot body 5 is part of a central retention assembly or pivot 50 that includes besides a retaining disk 20, a locking disk 8, a maintenance cover 21, and a locking and unlocking clamp 22. Alternately, the pivot body 5 and the retaining disk 20 could be one and the same piece.

Figure 6:
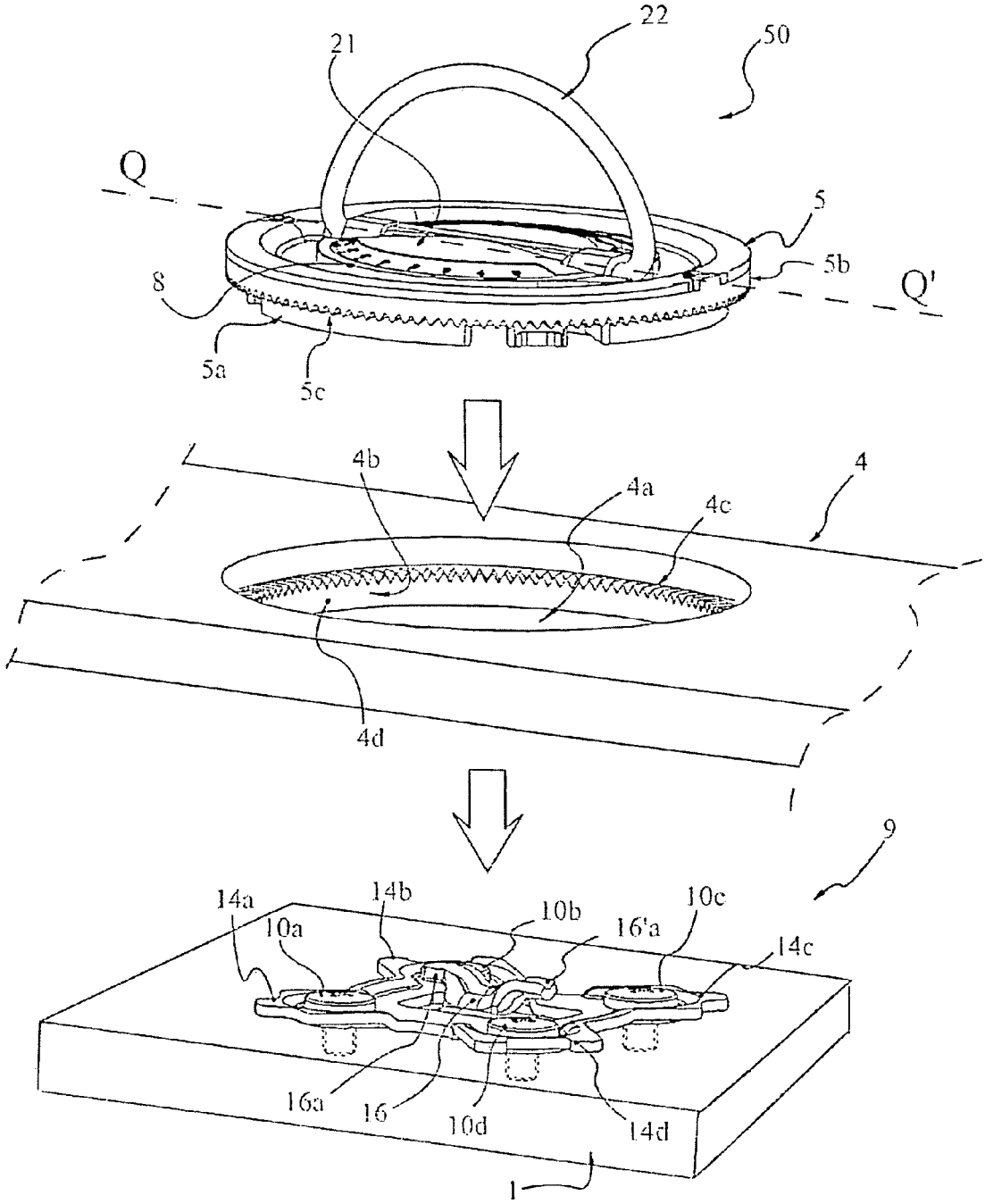
FIG. 6 is a perspective view before the plate is mounted to the base, the pivot being assembled, nearing it's mounting, so as to say, solidly with the base affixed to the snowboard.

The maintenance cover 21 has the general form of a cylindrical disk of which the wall 21*a* includes diametrically opposite recesses 21*b* advantageously open toward the bottom, in which are received the free ends 22*a*, 22'*a* of the arms 22*b*, 22'*b* of the locking and unlocking clamp 22. Thus, the aforementioned clamp 22 that has the form of an open buckle, is pivotally mounted on the maintenance cover 21 for rotation around the transverse and horizontal axis (Q, Q'), of the two free arms 22*b*, 22'*b* in the recess 21*b* of the aforementioned cover. One will note, that the rotating of the clamp 22 around the transverse and horizontal axis (Q, Q'), allows for it to take two positions, a locking position according to which the clamp is disposed in a generally horizontal plane, as illustrated in FIGS. 3, 7, 9, 9*a*, and an unlocking position in which the clamp is disposed in a generally vertical plane as illustrated in FIGS. 6, 8, 8*a*. Note, also as the free arms 22*b*, 22'*b* of the clamp do not have a circular cross-section, but a section that forms a cam, to constitute a pressing cam, of such sort that in locking position as illustrated in FIGS. 3, 7, 9, 9*a*, the cam causes by its reciprocal pressing between the retention disk 20 and the pivot saddle 8*f*, 8'*f* of the central locking disk 8 a pressing effect and a stable locking position.

The central locking disk 8 includes an external peripheral wall that forms two diametrically opposite recesses 8*a*, 8'*a*, formed by the saddles 8*f*, 8'*f*, in which the free arms 22*b*, 22'*b* of the locking and of unlocking clamp 22 are engaged. Thus, the aforementioned clamp 22 is pivotally mounted on the retaining disk, around the transverse axis (Q, Q'), by rotation of the two free arms 22*b*22'*b* in the diametrically opposite recesses 8*a*, 8'*a*.

The central locking disk 8 includes a central hole 8*b* provided to receive and cooperate with the base 9 as that will be described below in the description. This central hole 8*b* includes also a peripheral edge 8*c* including on its horizontal face 8*d* turned toward the top, a ramp or cam system with two symmetric diametrically opposite ramps 8*f*, 8'*f*, each advantageously including a circle of teeth 8*g* constituted of a succession of projections and of radial troughs whose function will be explained. It will be noted from the preceding that the system of ramps is situated on the upper face of the locking disk, that is to say, runs upward.

The two mechanical ramps 8*f*, 8'*f* act as tightening cams by their cooperation with the locking projections 16*a*, 16'*a* of the base 9. To this effect, the peripheral edge 8*c* includes two portions of the peripheral edge, such as the pressure applied by each of these portions varies. Thus, the disk includes two portions of the symmetrical peripheral edges having a first portion A-B and a second portion A'-B'diametrically symmetric to the first portion, the pressure from the edge at the level of the points A and A'being greater than the pressure from the edge at the level of the points B and B', the pressure diminishing progressively from points A, A'towards points B, B'.

One will also note that as the central hole 8*b* of the central locking disk 8 includes two radial clearances 8*h*, 8'*h* defined in the peripheral edge 8*c* allowing, as we will see, for the passage of the horizontal locking spindle 16, and particularly of its two locking projections 16*a*, 16'*a*.

The retention disk is sandwiched between the pivot body 5 and the central locking disk 8. The disk is a sufficiently rigid piece to take the forces exerted on the pivot body. Thus, the pivot body 5, the retention disk 20, the central locking disk 8, the maintenance cover 21 with the pivoting locking clamp 22 constitutes the central retaining body 50 provided to maintain the platen 4 on the snowboard 1 by its cooperation with the base 9, and particularly by the cooperation of the ramps 8*d*, 8'*d* of the central locking disk with the locking projections 16*a*, 16'*a* of the horizontal branch of the locking spindle 16 of the base 9.

Note that the rotation of the locking and unlocking body 15 constituted of the central locking disk 8 and the maintenance cover 21 with its clamp 22 is limited by an abutment system formed by the cooperation of two projections 24*a*, 24*b* extending towards the bottom in the base recess 17 at the periphery of the central hole of the pivot body 15 with ends of the attaching legs 21*c*, 21'*c*, as represented in FIG. 10.

One will add that the retaining disk 20 includes one abutment 20*a* to limit the rotation of the central locking disk 8. This one abutment 20*a* is advantageously formed by a projection disposed on the upper surface 20*b* of the retention disk 20 and is an abutment for the clamp 22 when the latter is in a folded back locking position.

It is to specify that the pivot body 5 with its retaining disk 20 forms a body that blocks rotational interaction with the base 9, while the central locking disk 8, the maintenance cover 21, and the clamp 22 form a manually movable locking element for rotational interaction with the base 9.

The base 9 is affixed to the upper surface of the snowboard 1 as is illustrated in FIG. 6, and the mounting of the platen 4 is done according to the following process.

The platen 4 is placed on the surface of the board, such that the base 9 is received in the center of the central hole 4*a* of the aforementioned base.

Next the user moves the pivot 50, so to say the central retaining body 50, forward such that a portion engages the base 9 and cooperates with the receiving recess 17, and another part engages the horizontal arms of the spindle and particularly its lateral locking arms 16*a*, 16*b* in the radial saddles 8*a* 8'*a* of the central locking disk 8.

Previously, the user will have taken care to place the clamp 22 vertically in a manner that its general plane is vertical, such as illustrated in FIG. 6. The body of the pivot 50 must be placed such that the pivot body 5 will be in a good place to cooperate with the corresponding central hole 4*a* of the platen 4, the platen having been positioned in the desired angular position. The engagement of the pivot 50 on the base 9 is finalized by rotation of the central locking disk until the locking projections 16*a*, 16*b* are disposed above the ramps 8*d* 8'*d* of the central locking disk 8.

The user will next lock the assembly and assure a good retention of the platen by rotation the central locking disk 8 with is maintenance cover 21, until tightening without play is realized by cooperation of the locking projections with the corresponding ramps. The user will next pivot the clamp downward to place it in its locking position in which its general plane is horizontal, such as illustrated in FIGS. 2, 7, 9, and 9A.

Figure 7:
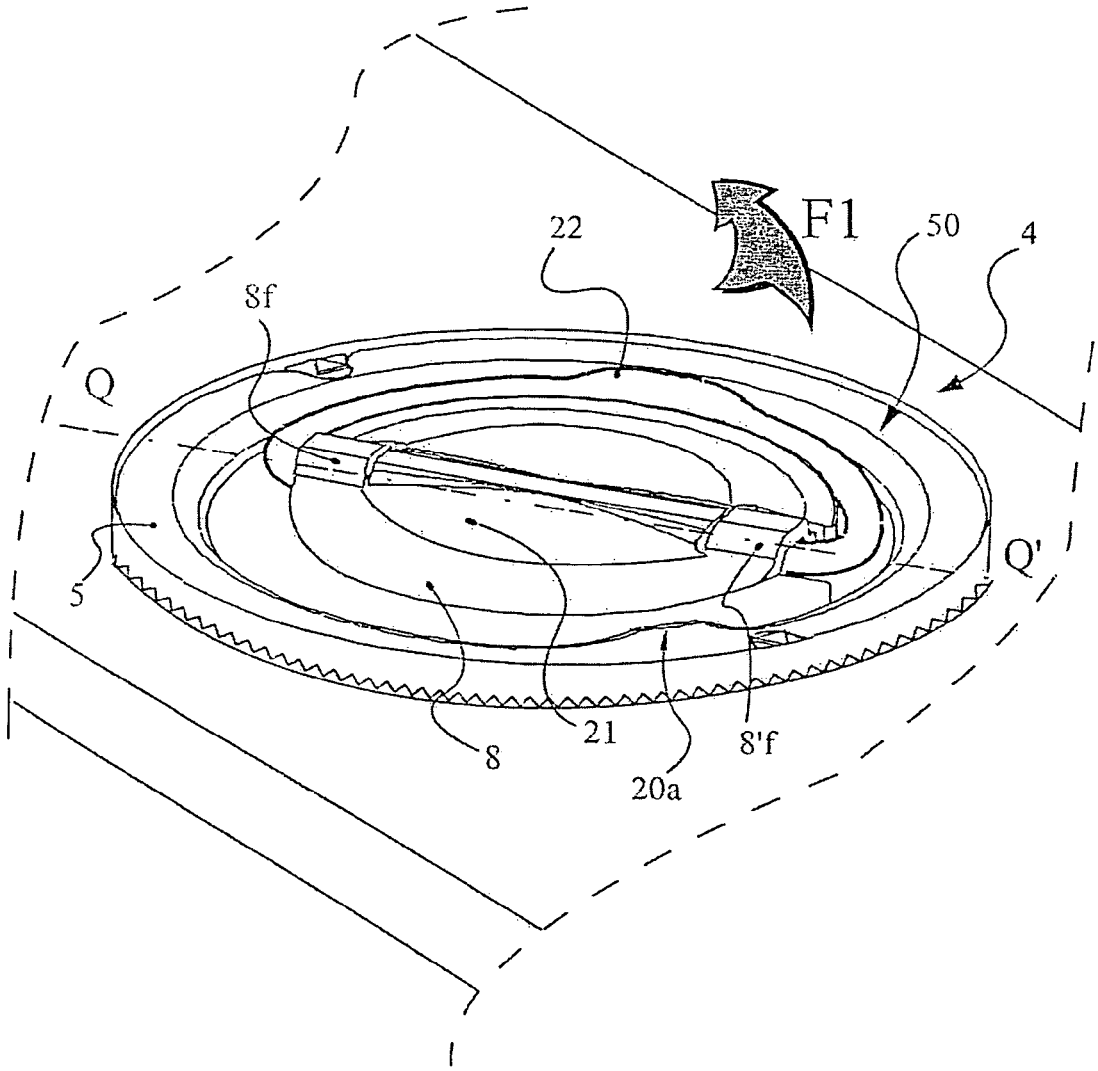
FIG. 7 shows a perspective view of the plate in a mounted and locked position.
Figure 8:
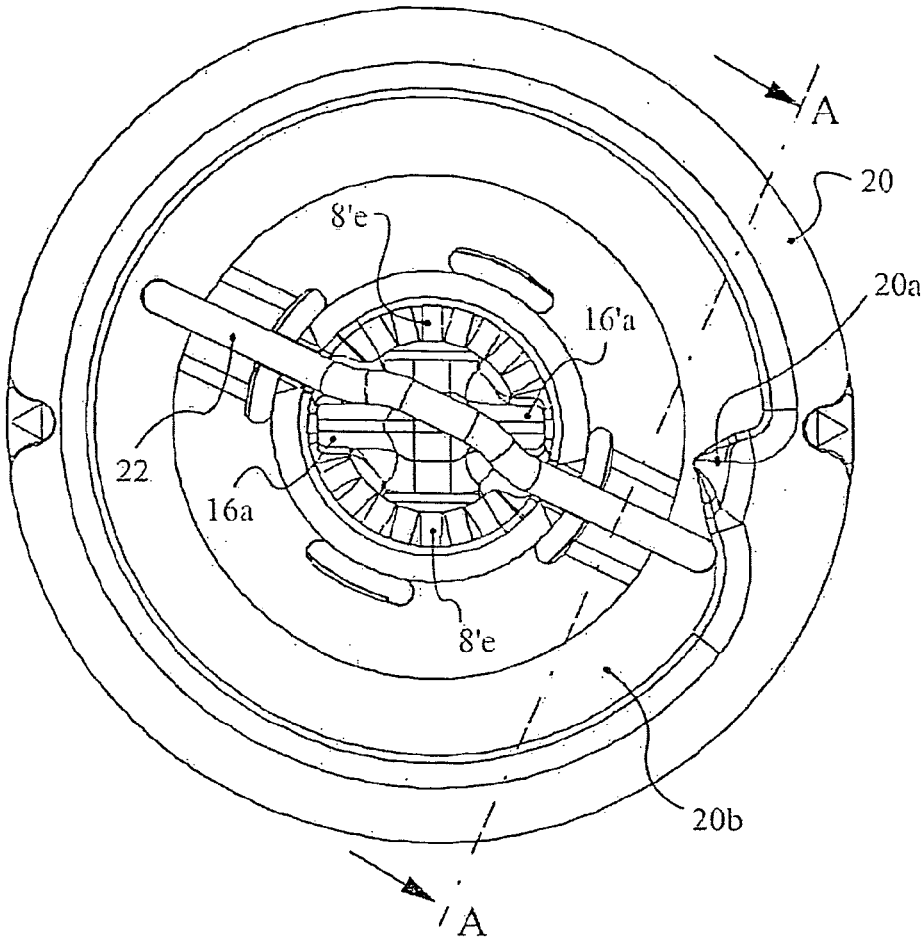
FIG. 8 is a top view of the pivot in place on the plate, without the maintenance cover, but with its locking and unlocking clamp in an unlocked position, the ramps of the central locking disk interacting with the locking projections, by its zones of less thickness.
Figure 8A:
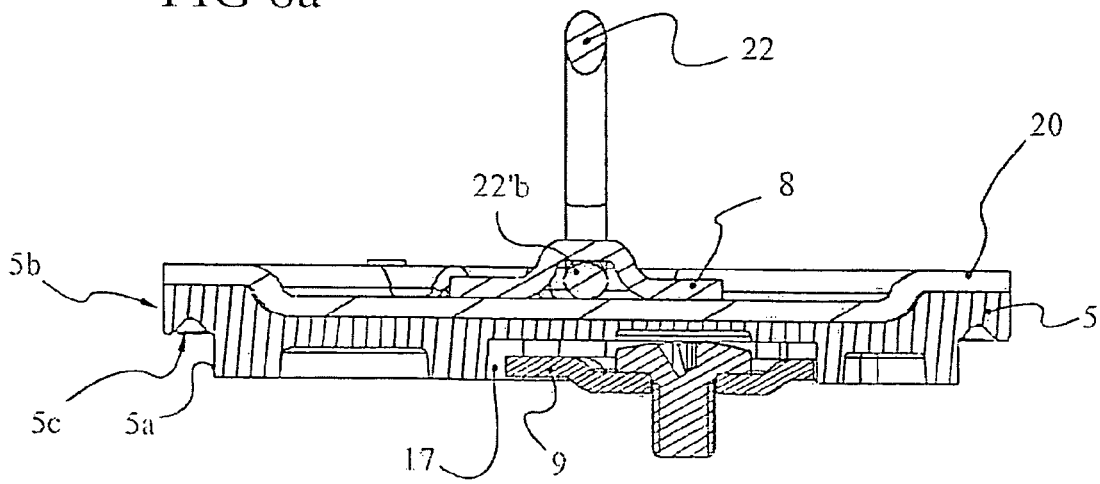
FIG. 8*a* is a cross-sectional view along A-A of FIG. 8, along which one can see the cams of the free arms of the clamp are in an inactive non-tightening position.
Figure 9:
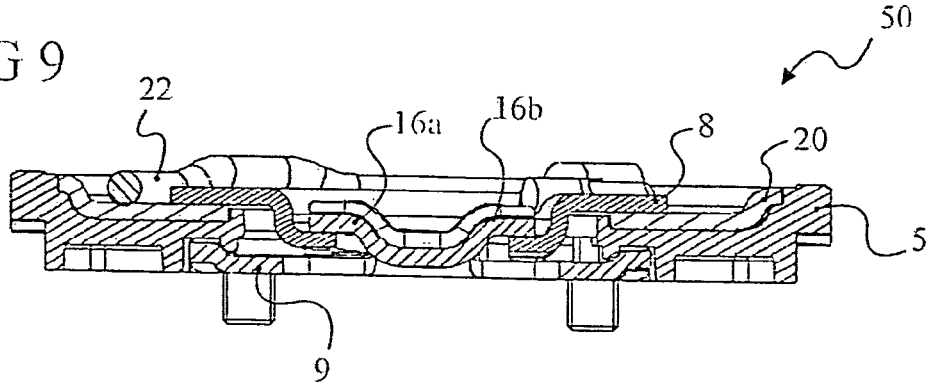
FIG. 9 is a top view of the pivot on the plate, without the maintenance cover, but, with its locking and unlocking clamp in a locked position, the ramps of the central locking disk interacting with the locking projections, by its zones of greater thickness.
Figure 9A:
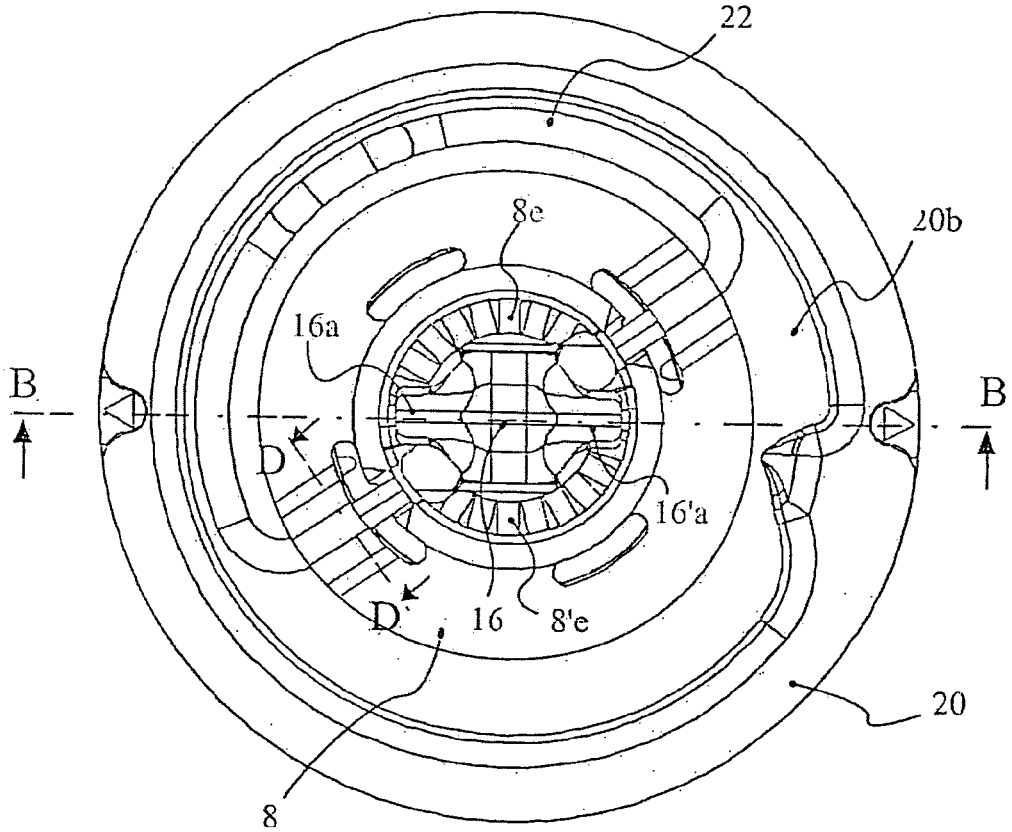
FIG. 9*a* is a cross-sectional view along B-B of FIG. 9.
Figure 9B:
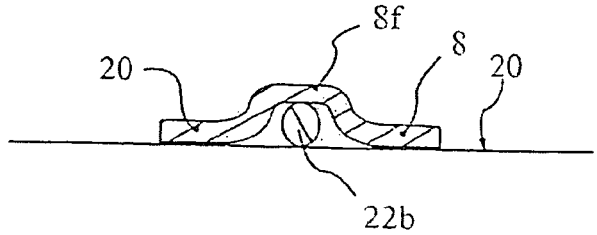
FIG. 9*b* is a partial cross-sectional view along D-D of FIG. 9*a*.

Inversely, from the position of FIG. 7, the user can raise the clamp to pivot upward according to F1, to move it from its locking position towards its unlocking position to release the pressing. In this position of the clamp, he will be able to rotate the central locking disk, releasing the interaction of the ramps of the disk with the locking arms. This release allows the user to disengage the teeth of the base from the teeth of the pivot body, and thus to modify the angular position of the base. Once the angular position is chosen, the user will be able to rotate the clamp to cause the ramps of the locking disk to engage and to assure the lock, then fold back the clamp to place it in the locking position.

At the time of the locking, there is in place a cooperation of the teeth 5*c* of the pivot body 5 with the corresponding teeth 4*c* of the platen 4. It will be understood, before fastening is complete, the user, by rotating the platen around the vertical axis (X, X') places it in the appropriate angular position. A position that he can at any moment modify with the preceding operation.

One will note that the general shape of the periphery of the base 9 and the general form of the periphery of the corresponding receiving recess 17 can have other forms than the one illustrated. The key being to have complementary forms that prevent the pivot body from moving relative to the base, in translation as well as in rotation. In the illustrated preferred embodiment, the cooperation between the base and the pivot body is achieved by mating projection and recess profiles.

Figure 12:
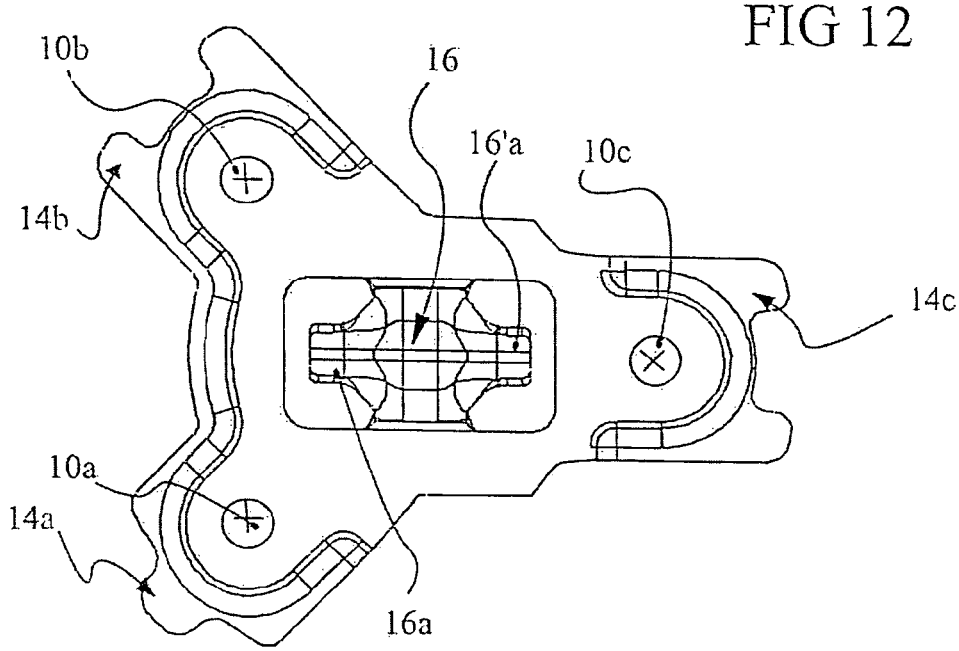
FIG. 12 is a top view of a variation illustrating a mounting of the base along the standard to three screws.

One will note equally that the chosen form of the base 9 was defined around the standard mounting on snowboard by four screws, but it is obvious that the form of the base could be defined around the standard of mounting by three screws, such as illustrated in FIG. 12.

One will understand that due to the system of ramps compensation will be able to be made to compensate for inevitable play due to fabrication or of wear. And the platen thus will always be exactly positioned on the snowboard.

Figure 13:
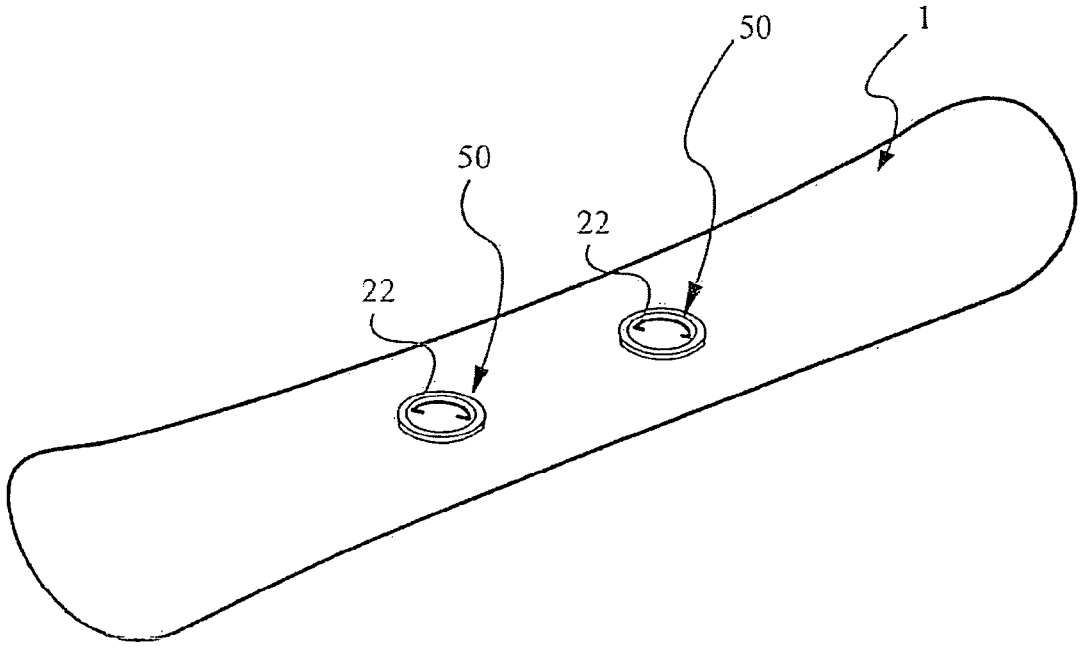
FIG. 13 is a perspective view showing a snowboard with the pivot but without the corresponding plate.

One also understands from the preceding, the platen 4 is retained on the base 9 that is affixed on the snowboard, thanks to a manual locking system, as the user will be able to maneuver manually at any moment and this without special tools. One has therefore a base that is affixed to the snowboard by a locking manual system of extreme simplicity. One will add that the device of the invention allows the user or the renting professional for example, to stock the board with only the bases that are there affixed on which the pivot can be mounted, such as shown in FIG. 13. Besides the type of platen destined to be mounted to the board will be able to be chosen to the last moment.

The invention has been described with reference to the preferred embodiments. Modifications and alterations may occur to others upon reading and understanding the preceding detailed description. It is intended that the invention be constructed as including all such modifications and alterations insofar as they come within the scope of the appended claims or the equivalents thereof.

The invention claimed is:

1. A retaining device for retaining a boot on a snowboard including:

a plate, provided with binding means for the boot, a pivot body with a vertical axis situated in the central zone of the plate, and destined to affix the plate on the snowboard by a manual locking system that assures the retention of the pivot body on a base affixed to the snowboard, an angular position of the plate relative to the pivot body being obtained by cooperation of a circular array of teeth defined on the plate with a corresponding circular array of teeth of the pivot body, wherein the base includes an anchoring or locking spindle including two anchoring or locking arms spreading horizontally towards the exterior from the vertical axis, wherein retention of the pivot body on the base is realized by cooperation of a system of ramps of a central locking disk, with the anchoring or locking arms, and wherein the central locking disk includes an external peripheral wall that forms two diametrically opposite recesses permitting the receipt of the two anchoring or locking arms, permitting disconnection of the plate from the base.

2. The device for retaining a boot on a snowboard according to claim 1, wherein the pivot body includes on its lower face a lower recess in which the base is engaged, the recess having complementary form to that of the base to prevent the pivot body from moving in translation or rotation relative to the base.

3. The device for retaining a boot on a snowboard according to claim 1, wherein the central locking disk includes a locking and unlocking clamp, movable between an unlocking position and a locking position.

4. The device for retaining a boot on a snowboard according to claim 1, wherein the central retaining body includes a retaining disk sandwiched between the central locking disk and the pivot body.

5. The device for retaining a boot on a snowboard according to claim 1, wherein the two locking arms extending horizontally towards the exterior from a vertical axis cooperate with the system of ramps on the central locking disk.

6. The device for retaining a boot on a snowboard according to claim 1, wherein the central locking disk includes a central hole to receive and cooperate with the base that includes a peripheral edge including on its upward horizontal face, a ramp system including two diametrically symmetric ramps.

7. The device for retaining a boot on a snowboard according to claim 1, further including a maintenance cover holding together the pivot body, a maintenance disk, and the central locking disk.

8. A snowboard adapted to be equipped with the devices for retaining a boot according to claim 1, including two bases.

9. The device for retaining a boot on a snowboard according to claim 2, wherein the plate includes a central hole to receive and cooperate with the pivot body, the central hole including a peripheral edge of which an upper transverse face includes the circular array of teeth defined on the plate.

10. The device for retaining a boot on a snowboard according to claim 9, wherein the central locking disk is rotatably mounted on the central retaining body for rotation around the vertical axis.

11. The device for retaining a boot on a snowboard according to claim 10, wherein the central locking disk is rotationally retained on the central retaining body.

12. The device for retaining a boot on a snowboard according to claim 11, wherein the central locking disk is retained on the central retaining body by a maintenance cover.

13. The device for retaining a boot on a snowboard according to claim 3, wherein the clamp is rotatably mounted on the central locking disk for rotation around a transverse horizontal axis.

14. The device for retaining a boot on a snowboard according to claim 13, wherein free arms of the clamp have a cross-section that forms a cam, such that in a locking position the cam provokes an effective reciprocal tightening force between the retaining disk and a saddle of the central locking disk.

15. The device for retaining a boot on a snowboard according to claim 6, wherein the two support ramps, include a circular array of projections and of radial troughs.

16. A device for retaining a boot on a snowboard comprising:

a plate provided with a binding for the boot;

a pivot body with a vertical axis situated in the central zone of the plate, and destined to affix the plate on the snowboard by a manual locking system that assures the retention of the pivot body on a base affixed to the snowboard;

a central locking disk including a central hole to receive and cooperate with the base, the central locking disk including a peripheral edge including on its upward horizontal face, a ramp system including two diametrically symmetric ramps;

wherein the retention of the pivot body on the base is realized by the cooperation of a system of ramps of a central locking disk, with at least a locking arm joined to the base;

wherein the two symmetric ramps form camming ramps by cooperation with the locking arms of the base, the peripheral edge including two edge peripheral portions, including a first edge portion and a second edge portion diametrically opposite and symmetric to the first edge portion, a height of each of these edge portions varies, such that the height of the surface at the level of end points is higher than the height of the surface at the level of beginning points, the height diminishing progressively from the end points towards the beginning points.

* * * * *